United States Patent [19]

Otthofer, Jr.

[11] 4,276,148

[45] Jun. 30, 1981

[54] EXPANDABLE MANDREL

[75] Inventor: Jacob A. Otthofer, Jr., Lancaster, Pa.

[73] Assignee: Armstrong World Industries, Inc., Lancaster, Pa.

[21] Appl. No.: 178,977

[22] Filed: Aug. 18, 1980

[51] Int. Cl.[3] ..... C25D 1/02; C25D 1/10

[52] U.S. Cl. ..... 204/281; 204/9

[58] Field of Search ..... 204/9, 281

[56] References Cited

U.S. PATENT DOCUMENTS

| | | | |
|---|---|---|---|
| 3,763,030 | 10/1973 | Zimmer | 204/9 |
| 4,177,113 | 12/1979 | Seibt | 204/281 |

FOREIGN PATENT DOCUMENTS

| | | | |
|---|---|---|---|
| 8108 | of 1892 | United Kingdom | 204/9 |
| 975147 | 11/1964 | United Kingdom | 204/9 |

OTHER PUBLICATIONS

U.K. Patent Appln. No. GB 2,011,473 A published Jul. 11, 1979.

*Primary Examiner*—T. M. Tufariello

[57] ABSTRACT

The mandrel herein is used for making seamless hollow cylinders by electrolytically forming cylinders on the expandable and contractable mandrel. The mandrel has an inflatable outer surface or jacket which permits it to be expanded or contracted for holding or removing the electroformed cylinder therefrom. The inflatable jacket is backed up by a perforated metal core.

1 Claim, 1 Drawing Figure

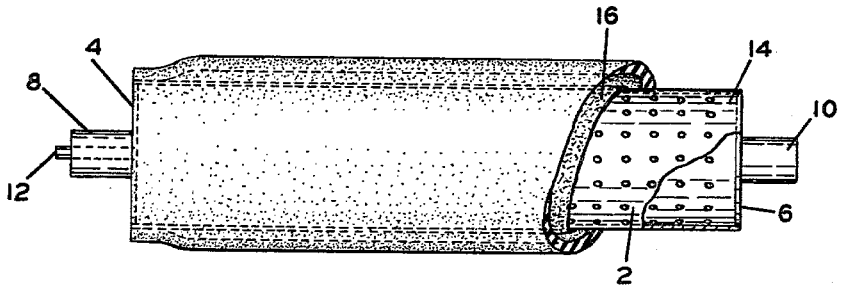
16
4
14
8
10
12
6
2

EXPANDABLE MANDREL

BACKGROUND OF THE INVENTION

1. Field of the Invention

The invention is directed to an apparatus for making seamless hollow cylinders and more particularly the invention is directed to an expandable and contractable mandrel.

2. Description of the Prior Art

U.S. Pat. No. 3,763,030 is directed to an expandable mandrel structure wherein the expandable jacket is supported by two endplates.

BRIEF DESCRIPTION OF THE DRAWING

The FIGURE of the drawing is a schematic view of a device according to the present invention and is partly in section.

DESCRIPTION OF THE PREFERRED EMBODIMENT

The invention herein is an improvement over that of U.S. Pat. No. 3,763,030 in which a perforated metal core is provided under the rubber covering to provide rigidity and support to the overall mandrel structure. This support is particularly noticeable when the rubber covering is being ground to its finished size and being formed concentric with the journals of the mandrel.

The mandrel is formed by fastening a perforated metal tube or core 2 on two endplates 4 and 6. To the center of the endplates 4 and 6 there are positioned journals 8 and 10. The journals 8 and 10 are not connected together and do not extend as a single piece through the perforated metal core. One of the journals is hollow and has an air valve 12 on the end thereof so that air may be inserted through the journal into the interior of the perforated metal core. The perforated metal core is made of metal about ¼ inch thick. It is provided with holes of ⅛ inch in diameter at 2 inch centers in both directions. The perforations extend through the main body of the metal core but no perforations exist on the circumference area 14 of the ends of the core 3 inches back from the edges of the core. Over top of the perforated metal core covering the perforations there is wrapped a conventional light weight kraft paper 16. Over top of the kraft paper and the metal core there is provided a rubber covering which in its finished size is about 7/16 of an inch thick. Originally, the rubber cover placed thereover is about 1 inch thick and it is vulcanized to the ends of the metal core in the 3 inch area 14 where no perforations exist. Due to the existence of the kraft paper, the rubber covering is not fastened to the metal core in the region where the perforations exist. The rubber covering is then subsequently turned down to provide a circumference for the rubber covering which is true with respect to the journals and very smooth in its finished configuration. The metal core assists in supporting the rubber covering during the turning operation so that a very smooth rubber covering can be secured. Over top of the rubber covering is positioned the matrix upon which is plated the seamless hollow cylinder which is to be formed in the electroplating operation. The dimension of the outside of the rubber covering is approximately 25 mils less than the dimension of the interior of the matrix. The matrix is slid over the rubber covering and then air to the pressure of 20–25 pounds is inserted into the interior of the metal core. This pushes the paper 16 outward and applies pressure against the rubber covering to expand the rubber covering to contact the matrix. Actually, the pressure of the rubber covering on the matrix expands the matrix itself about 5 mils greater than its diameter before it was placed on the mandrel. After the electroplating operation is carried out, the air pressure is released from the interior of the metal core, the rubber covering contracts, and now the matrix may be removed from the mandrel.

What is claimed is:

1. The mandrel for forming seamless hollow cylinders comprising in combination:

(a) a pair of axially aligned, spaced apart end plates, a journal positioned centrally of each end plate and extending outwardly from the end plate, said journals extend from opposite sides of the two end plates and not into the area between the two end plates, (b) a cylindrical perforated metal tube connected to said end plates and interconnecting together said two end plates, (c) means for supplying air to the region between the perforated metal tube and the two end plates, (d) a paper positioned over the periphery of the perforated metal tube to cover the perforations therein, said paper not covering the surface of the perforated metal tube in the region adjacent the edges of the tubes, (e) a rubber jacket being positioned over the perforated metal tube and being bonded to the area of the perforated metal tube not covered by the paper, and (f) said means which provide air to the interior of the perforated metal tube providing air to the interior of the tube whereby the air will pass through the perforated metal tube and will push past the release paper to apply pressure on the rubber jacket to expand said rubber jacket, release of said air pressure will permit contraction of said rubber jacket so that a matrix element may be positioned on the outside of the rubber jacket and due to the expansion and contraction of the rubber jacket, be held on the mandrel or released from the mandrel.

* * * * *